United States Patent [19]

Inglett, Jr. et al.

[11] Patent Number: 4,537,015

[45] Date of Patent: Aug. 27, 1985

[54] BAG PLACER FOR A PACKAGING MACHINE

[75] Inventors: Wilfred L. Inglett, Jr.; Walter M. Ashley, Jr., both of Augusta; Abe J. Manfredonia, Evans, all of Ga.

[73] Assignee: Inglett & Company, Inc., Augusta, Ga.

[21] Appl. No.: 529,113

[22] Filed: Sep. 2, 1983

[51] Int. Cl.[3] ..... B65B 43/18; B65B 43/30; B65B 43/46

[52] U.S. Cl. ..... 53/386; 53/255; 53/571; 493/313

[58] Field of Search ..... 53/255, 384, 385, 386, 53/570, 571, 573; 493/313, 316, 317

[56] References Cited

U.S. PATENT DOCUMENTS 3,044,231 7/1962 Blais et al. ..... 53/571
3,945,173 3/1976 Buzzi ..... 53/571

*Primary Examiner*—Robert L. Spruill
*Assistant Examiner*—Richard M. Mudd
*Attorney, Agent, or Firm*—Kane, Dalsimer, Kane Sullivan & Kurucz

[57] ABSTRACT

A bag placer which automatically takes a bag from a stack, opens and shapes the bag and places such bag on a spout so that compressed material, such as insulation, glass wool and the like, can be rammed into the bag through the spout. The bag placer is particularly suited for plastic bags which are difficult to handle and open and place on a spout.

3 Claims, 12 Drawing Figures

FIG. 4
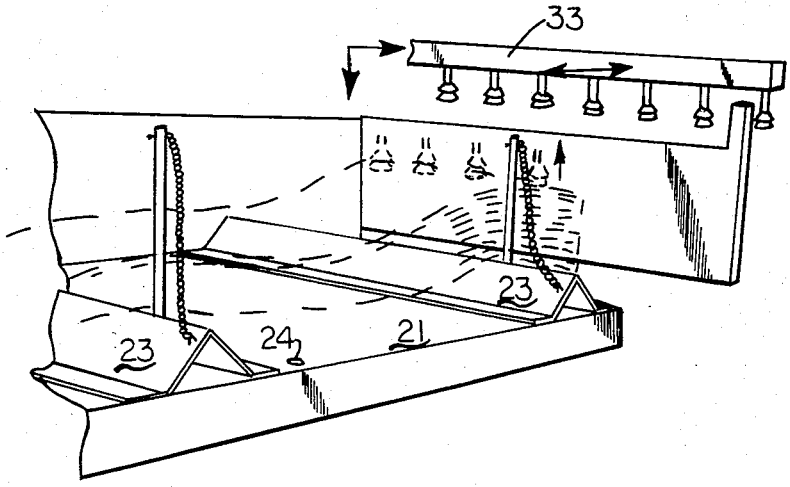
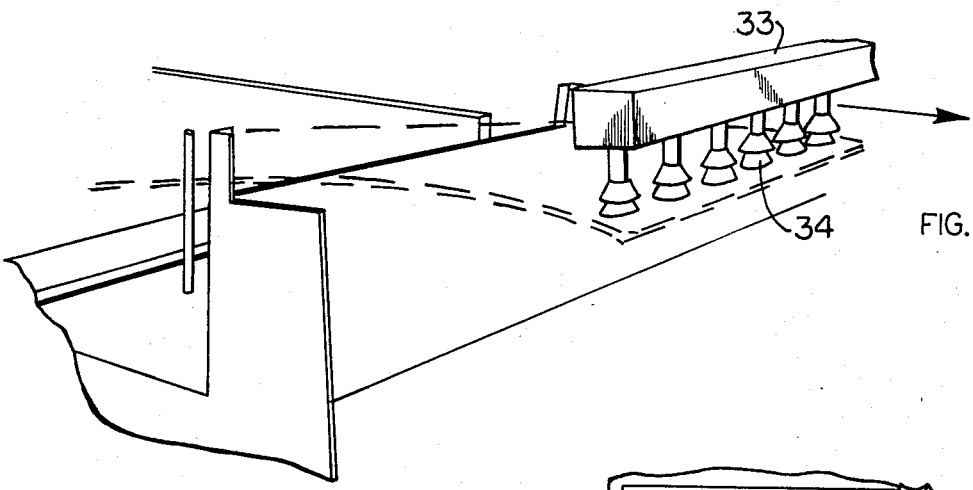
FIG. 5
FIG. 8
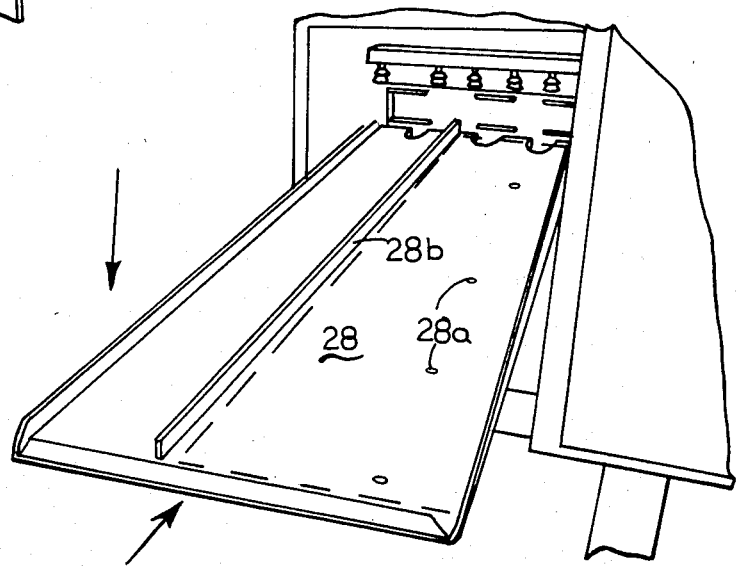

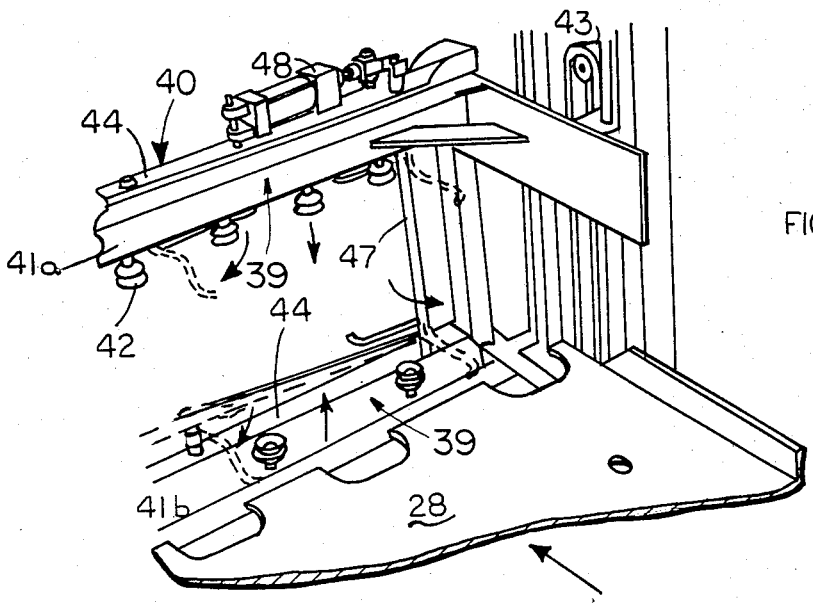
FIG. 9
FIG. 10
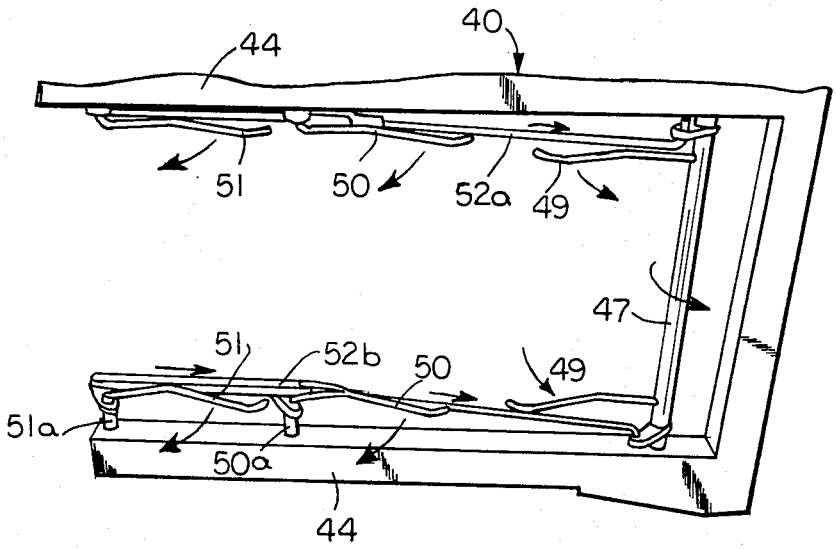

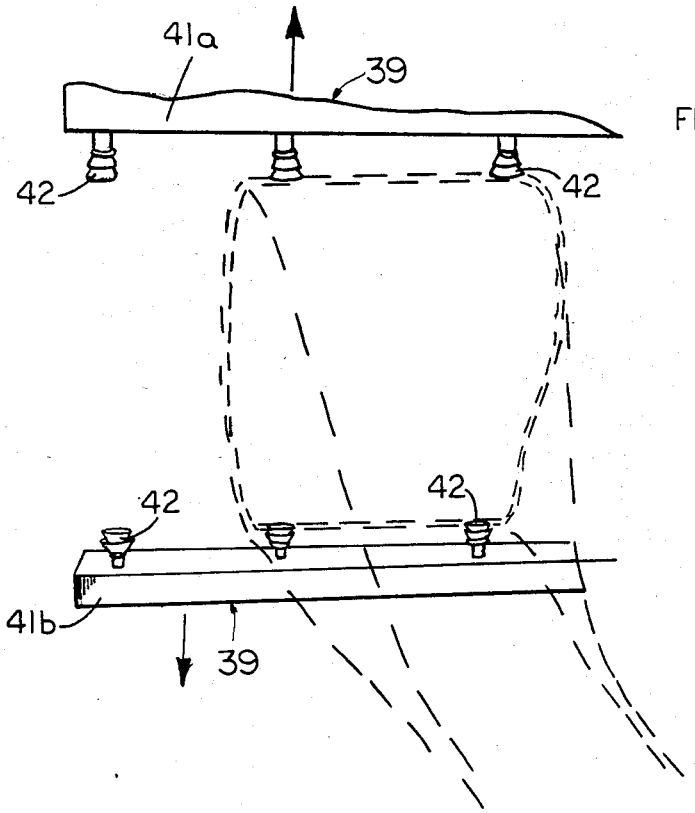
FIG. 11
FIG. 12
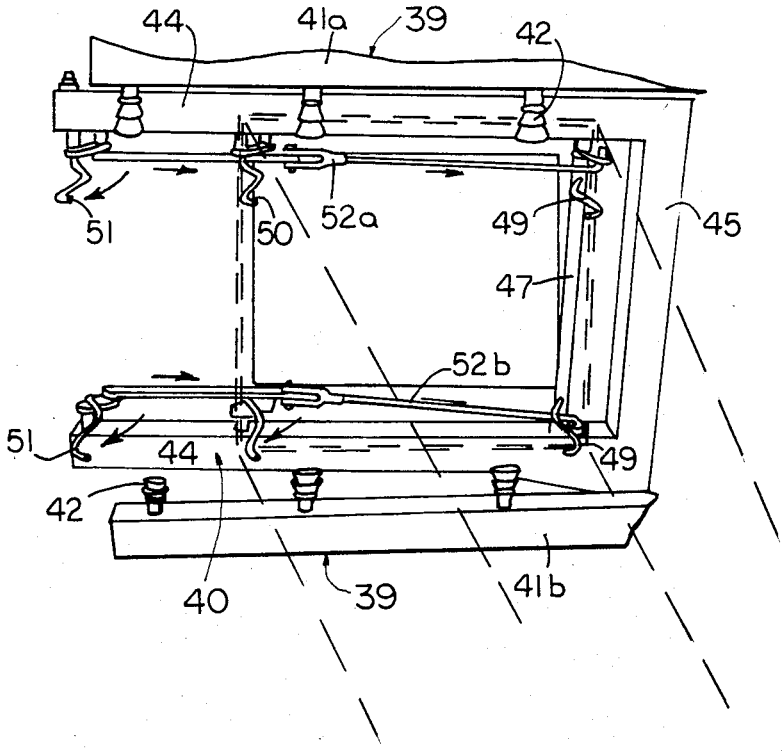

BAG PLACER FOR A PACKAGING MACHINE

BACKGROUND OF THE INVENTION

1. Field of the Invention

This invention relates to machines for packaging highly compressed materials, such as insulation, glass wool and the like, in plastic bags and more particularly to the apparatus for placing such a bag on a spout so that the compressed material can be inserted into the bag to form a neat and tight package.

2. Brief Description of the Prior Art

At the present time the plastic bags are placed on the spout by hand preparatory to receiving the compressed material. Because of the limp nature of the plastic bags used to package such materials the bags are difficult to open and place on the spout by hand. The present invention is directed to apparatus which automatically takes a bag from a stack, opens and shapes the bag and places such bag on the spout so that the compressed material can be rammed into the spout and bag.

The apparatus of the present invention is an improvement over the hand operation in that it is faster, more reliable in positioning the bag on the spout and saves labor.

SUMMARY OF THE INVENTION

The invention comprises apparatus for placing a bag on a spout to receive a tightly compressed material comprising:

a magazine to hold a stack of bags open at one end and facing in the same direction;

a spout positioned below the magazine, the said spout having expandable jaws to grip a bag;

an elevator moveable between an up position adjacent the magazine at the closed ends of the bags and a down position aligned with the spout;

a gripper arm moveable from a position over the closed ends of the bags on the magazine along the length of the elevator, the said gripper arm having grippers extendable into the magazine to grip and lift the closed end of the top bag in the stack;

means to move the gripper bar and the bag held by the grippers along the elevator and place the bag on the elevator;

means to lower and raise the elevator;

upper and lower opening bars provided with vacuum cups facing each other positioned adjacent the bag end of the spout;

means to move the elevator and bag horizontally to bring the open end of the bag between the opening bars to permit the opening vacuum cups to grip the top portions of the opposite faces of the bag;

means to separate the opening bars and open the bag;

a finger assembly comprising a pair of bars moveable horizontally on stationary rods along the opposite faces of the spout and fingers adapted to rotate into the mouth of the bag when the bag is almost opened and grip the bag;

means to move the bars of the finger assembly and the bag gripped by the fingers onto the spout for almost the full length of the bag; and means to expand the jaws of the spout;

whereby the bag will be held on the spout ready to receive the compressed material through the spout and then be pushed from the spout.

BRIEF DESCRIPTION OF THE DRAWINGS

In the drawings:

FIG. 4 is a view similar to that of FIG. 3 showing the bag gripper bar;

FIG. 5 is a view showing the bag gripper bar with the vacuum cups holding a bag being moved from the magazine to the elevator;

FIG. 8 is an end view of the apparatus taken along the line 7—7 of FIG. 6;

FIG. 9 is a view showing a portion of the elevator, the bag opening mechanism and the rotating fingers for shaping and holding the open end of the bag;

FIG. 10 is a view showing the fingers for shaping and holding the open end of the bag prior to the rotation of such fingers into the bag;

FIG. 11 is a view showing the vacuum cups of the bag opening mechanism opening the end of the bag; and FIG. 12 is a view similar to that of FIG. 10 showing the bag opening mechanism and the fingers after rotation into the bag.

DETAILED DESCRIPTION OF THE PREFERRED EMBODIMENT OF THE INVENTION

The bag placer of the present invention is intended for use with machines which compress materials, such as glass wool and the like, and insert the compressed material into a bag to form a neat and tight package. Such machines are well known and hence will not be described in detail herein.

The subject bag placer incorporates a magazine for storing a large plurality of empty, collapsed bags in a stack. The placer is particularly suitable for large plastic bags which may vary in width from 12 to 30 inches and in length from 30 to 60 inches and are difficult to handle. The magazine may hold a stack of approximately eight inches in height of about 300 plastic bags. Although gusseted plastic bags are in wide use for packaging such compressed materials, the placer of the present invention will work well with all types of bags whether gusseted or not. A bag is moved from the stack to an elevator which lowers the bag so that it is aligned with a filling spout. The bag is opened and placed on the spout ready to receive the compressed material. Such material is inserted through the spout into the bag and the bag is thus pushed from the spout.

Figure 1:
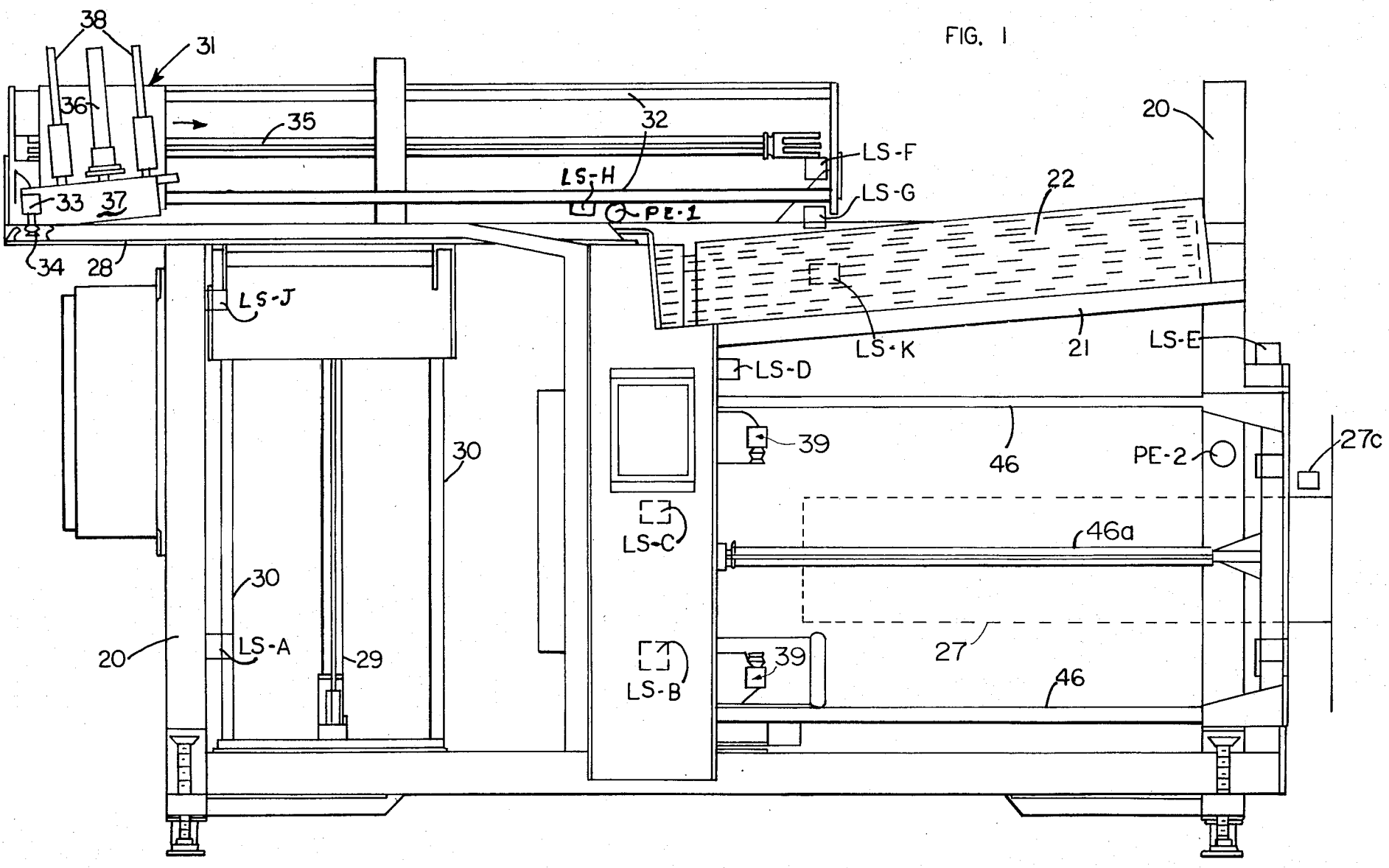
FIG. 1 is a side elevation of the apparatus of the present invention.
Figure 2:
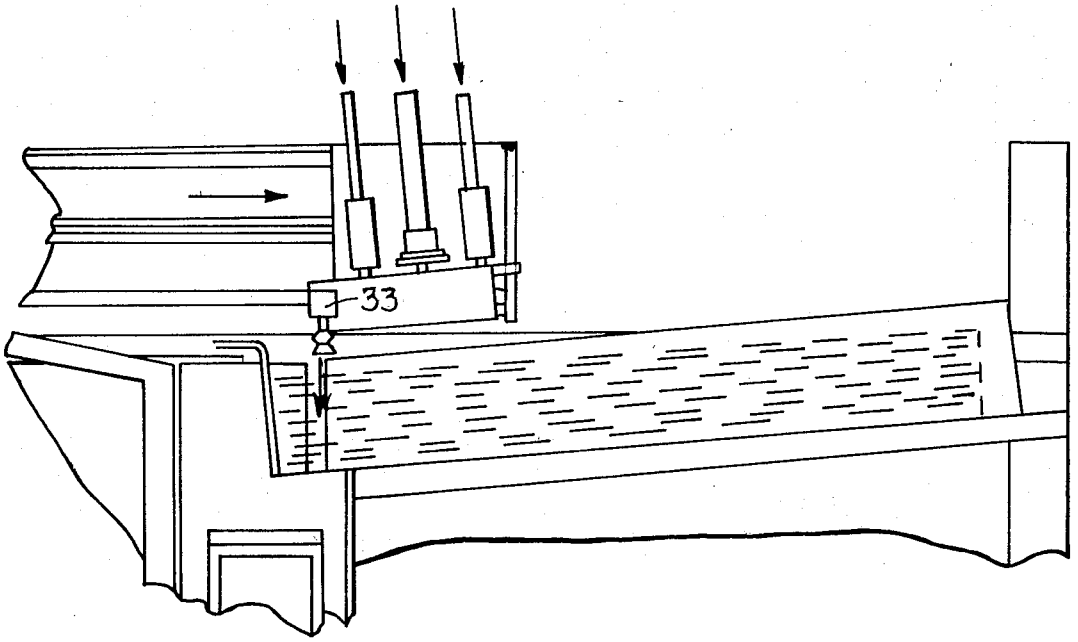
FIG. 2 is a side elevation of the bag magazine showing the gripper mechanism for moving a bag from the magazine to the elevator.
Figure 3:
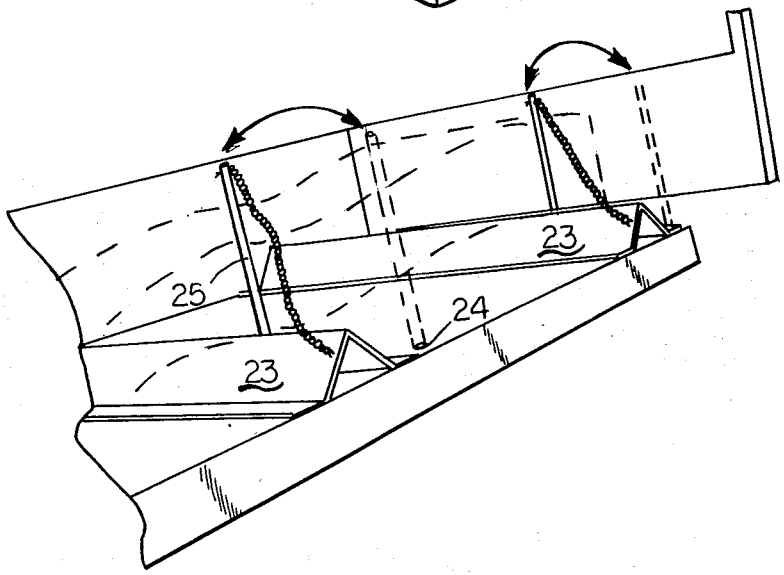
FIG. 3 is a view of the bag magazine showing the triangular tubes for retaining the bags in position on the magazine and the pins for insertion, into the magazine for bags of different size.

Referring to the drawings, FIG. 1 shows a side elevation of the bag placer apparatus of the present invention in which a main frame 20 supports the various units of the apparatus. A bag magazine 21, extending along one end of the apparatus is adapted to hold a stack of bags 22 with all the closed bottom ends of the bag facing toward the center of the apparatus. In the case of plastic bags the stack might be approximately 300 bags formed a stack of about eight inches. Since plastic bags are difficult to handle it has been found helpful in keeping the bags at one end of the magazine to tilt the magazine about 5° in that direction. In addition, to help hold the stack of bags in position there are two triangular chines or ribs 23 running across the magazine (FIGS. 3 and 4). To adapt the magazine for bags of different width the base of the magazine is provided with lines of holes 24 at different widths to receive pins 25 with chains 26 to prevent the pins from being misplaced.

Directly below the magazine is a filling spout 27 affixed to the frame. Such spout is a rectangular tube open at both ends so that a bag can be pulled over one end of the spout and the compressed material can be fed into the opposite end of the spout. The spout may be provided with expandable jaws 27*a* and 27*b* (FIG. 7) at the bag end, so that the bag can be slipped on the spout easily and held firmly on the spout when the jaws are expanded by means 27*c*.

Figure 6:
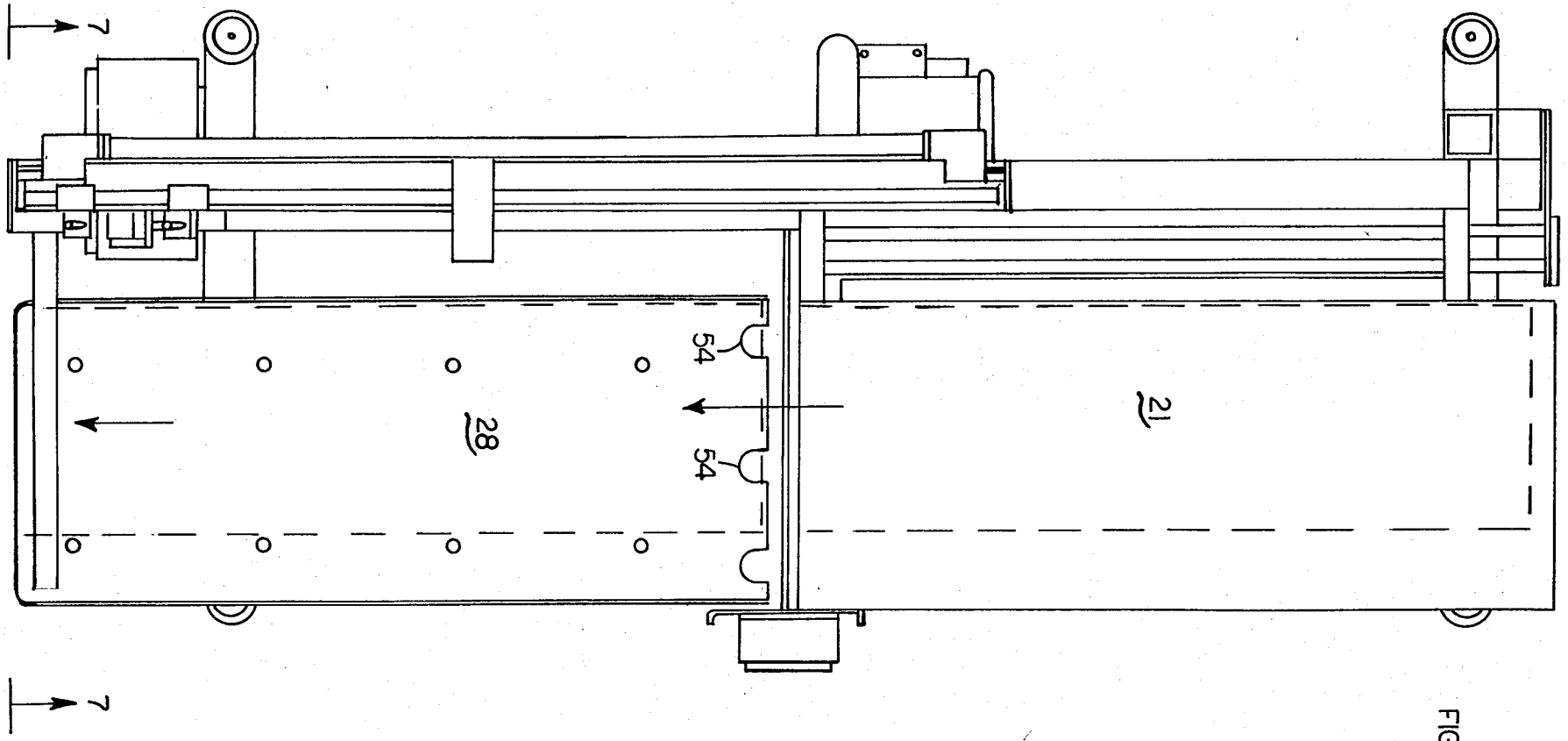
FIG. 6 is a top view of the bag magazine and elevator.

An elevator 28 is positioned in the apparatus so that it can move up and down with the up position being adjacent the bottoms of the bags in the magazine and the down position aligned with the bag end of the filling spout. The elevator is moved up and down by a cable cylinder 29 secured to the frame and is guided on linear ball bearing along a pair of stationary bars 30 also secured to the frame (FIGS. 1, 6 and 8).

Mounted on the frame is a gripper arm assembly 31 which comprises a pair of stationary rods 32 running from the closed ends of the bags in the magazine 21 for the full length of the elevator 28, a gripper arm 33 which runs along such stationary rods 32 and extends over the width of the bags and the elevator, grippers in the form of vacuum cups 34 mounted on the gripper arm, a cable cylinder 35 for moving the gripper arm 33 and vacuum cups 34 along the stationary rods 32, an air cylinder 36 for moving the gripper arm 33 and vacuum cups 34 up and down, a gripper arm support 37, and guide rods 38 along which the support 37 and gripper arm 33 move. This gripper arm assembly provides the means for the vacuum cups 34 to move into position over the closed end of the top bag in the magazine, descend into the magazine to grip the bag, lift the bag, and then slide the bag from the magazine onto the elevator, as will be more fully described hereinafter (FIGS. 1, 2, 4, 5 and 6). If narrow bags are being used and some of the vacuum cups beyond the width of the bags are not required, such cups can be plugged.

Figure 7:
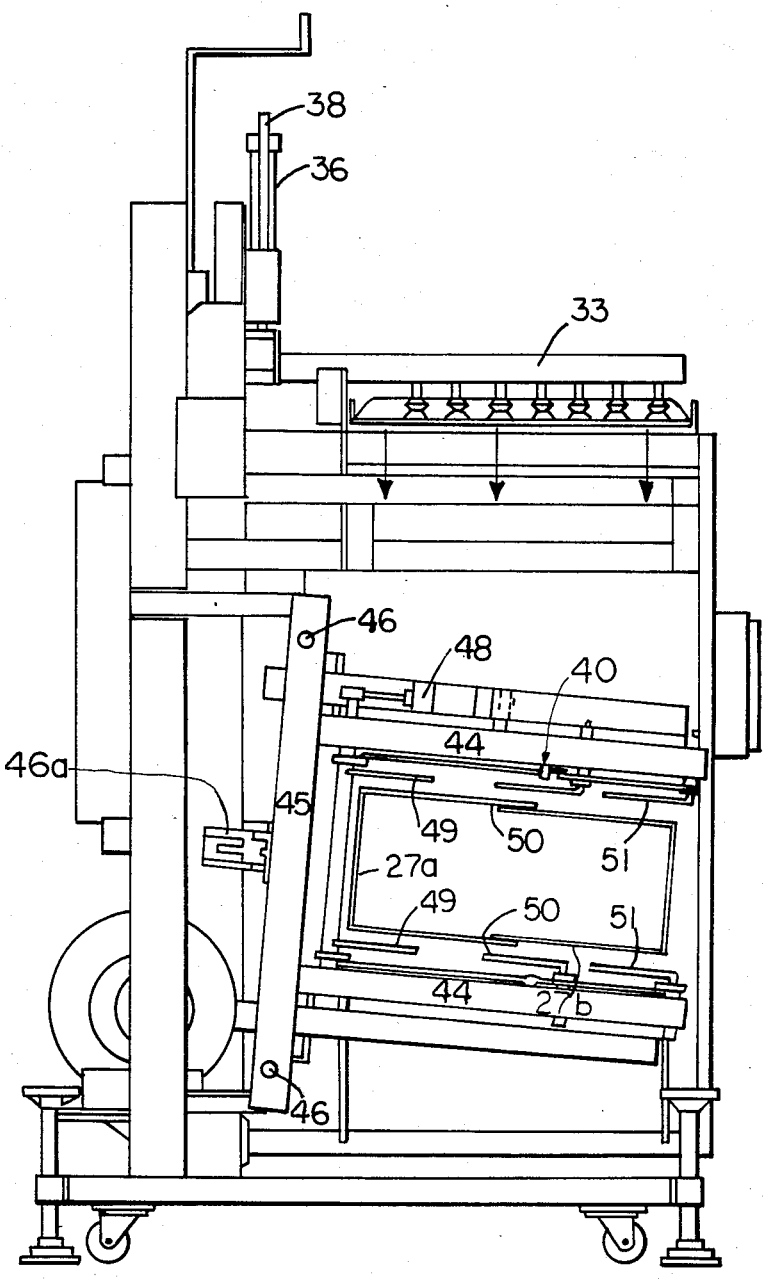
FIG. 7 is a view showing the elevator in relation to the bag gripper bar.

As pointed out above, when the elevator is in the down position it is aligned with the filling spout. Interposed between the elevator and spout are a bag opening assembly 39, which opens the bag, and a finger assembly 40 which slides the opened bag onto the filling spout (FIGS. 7, 9 and 11).

The bag opening assembly 39 (FIGS. 1, 9 and 11) comprises a pair of opening bars, opening vacuum cups 42 positioned on the bars so that the upper and lower cups face each other and are aligned with each other, and an air cylinder-sprocket-chain assembly 43 for moving the bars 41 and cups 42 together and apart. In the latter assembly an air cylinder 43 moves the top opening bar 41*a*, which is connected to a sprocket and chain, which in turn is connected to the lower opening bar 41*b*, so that the two bars are timed and separate and come together in unison. Vacuum is continuously applied to the vacuum cups 42. Here again, any vacuum cups not required because a narrow bag is being used may be plugged.

The finger assembly 40 (FIGS. 7, 10 and 12) is positioned adjacent the opening bars 41 and comprises a pair of bars 44 held by a support member 45, with the bars spaced to ride along the upper and lower faces of the spout, stationary rods 46 to carry the support member 45 and bars 44 horizontally along the spout, a cable cylinder 46*a* to move the assembly on linear ball bearing bushings along the rods 46, an air cylinder 48 mounted on the upper bar and interconnected to a shaft 47 which can be rotated by the air cylinder 48, a pair of upper and lower fingers 49 mounted on the shaft 47, a second and third pair of upper and lower fingers 50 and 51 mounted on shafts 50*a* and 51*a* rotatable on the bars 44, and linkage 52*a* and 52*b* connecting the shaft 47 with the shafts 50 and 51 to turn all of the fingers to positions projecting from the bars 44. The third pair of fingers 51 are for a wider bag whereas the second pair of fingers 50 are for a narrower bag. The fingers are adapted to rotate into the mouth of the opened bag. Such fingers in their projected position press against the inner faces of the bag, so that the open end of the bag will conform in shape to the spout. The fingers apply sufficient pressure to the bag so that the bag, gripped and held by the finger assembly, can be moved horizontally and slid onto the spout for almost the full length of the bag. The jaws 27*a* and 27*b* of the spout are then expanded to hold the bag on the spout. The fingers are then retracted from the bag.

The bag placer of the present invention operates as follows: The operator loads bags on the magazine with the pins 25 set in the proper holes in the magazine for the width of bags to be filled. At this stage the elevator table is in a raised position and the jaws of the spout are in a retracted position. The elevator is also provided with holes 28*a* and a guide bar 28*b* with pins which can be placed in the proper holes for the width of the bag. Control circuitry is provided for interrelating the operation of the bag placer with the filling machine so that the bags can be fed to the filling spout as needed and commensurate with the filling machine.

The sequence of operations consists of loading the bag from the magazine onto the elevator and then loading the bag that is on the elevator table onto the spout of the machine that will fill the bag.

The function of placing a bag on the elevator table is initiated by a signal automatically given and described hereinafter, or by a signal manually given by the operator pushing the button on the instrument panel to load a bag. The signal moves the gripper arm and vacuum cups horizontally from their position over the elevator table to a position over the bottom end of the top bag in the magazine. As the gripper arm and vacuum cups travel forward toward the magazine the limit switch (LS-H) is contacted which will override the photo electric cell (PE-1). When the gripper arm and vacuum cup assembly makes contact with the limit switch (LS-F) an air solenoid will be actuated which will cause the vacuum bar with the vacuum turned on to move downward so that the cups contact and grip the bottom end of the top bag in the magazine. On the way down the vacuum bar will make contact with limit switch (LS-G) which will cause the air cylinder to move the vacuum bar upward again making contact with limit switch (LS-F). There is a vacuum switch mounted in the vacuum line. If a bag has been picked up the vacuum switch will cause the vacuum bar assembly to slide horizontally and pull the bag onto the full length of the elevator table at which point a switch shuts off the vacuum. As the vacuum bar assembly travels rearward the limit switch (LS-H) is released and the photo electric eye (PE-1) is now in control of the rearward motion of the vacuum bar assembly. When the mouth of the bag passes the photo eye the photo eye will cause the vacuum bar assembly to stop and deposit the bag on the table in the correct position.

To place the bag on the spout of the batt machine the operator may push a button which causes the machine to place a bag on the spout or a bag may be placed by an external signal from the batt machine. When the signal is received the elevator table moves downward until contact is made with limit switch (LS-A). This causes the elevator table holding the bag to stop in a position aligned with the spout and the upper and lower vacuum cups on the opening bars of the bag opening assembly. At this stage the opening bars are separated sufficiently to receive the flat bag and elevator. The activation of limit switch (LS-A) also causes the elevator table containing the bag to move forward into the center of the opening bars. Simultaneously, the opening bars close on the bag. Such bars will be positioned along the top edges of the two faces of the bag. It will be noted that the end of the elevator is provided with cutouts 54 so that the cups can come in direct contact with faces of the bag.

When the opening bars completely close the limit switch (LS-B) is actuated which will cause the bars to open and the elevator table to move back. As there is a vacuum present on the vacuum bars the mouth of the bag is opened. The finger assembly will have moved to its rearward most position with fingers in the retracted position. As the vacuum bars open the limit switch (LS-C) is contacted which activates the air cylinder on the finger assembly. This causes the shaft and associated linkage to turn the fingers into the mouth of the bag thus snapping open and grabbing the bag away from the vacuum cups. The fingers apply sufficient pressure so that the bag is firmly held and gripped. It also causes the finger assembly to move forward over the spout on the batt machine. The bag is moved along the spout until the bag is in final position on the spout. At this stage the spout is into almost the full length of the bag.

The finger assembly working limit switch (LS-D) will cause the bag placer to get another bag from the magazine to be put on the elevator table. The finger assembly will pull the bag onto the spout until it reaches the end of the travel where limit switch (LS-E) will be activated. This will cause the elevator table to go up to its resting position, ready for the start of the next cycle. Limit switch (LS-E) will trigger photo eye (PE-2) and limit switch (LS-J). When photo eye (PE-2) and limit switch (LS-J) are activated a signal will be sent to the batt machine indicating a bag is in place and that the material feeding machine can feed the compressed material into the spout. The material is rammed through the spout into the bag and the filled bag is pushed from the spout. The bag placer cycle ends at this point and awaits a signal for the next cycle to start.

Those skilled in the art will appreciate that many variations of the above described embodiment may be made without departing from the spirit and scope of the invention.

What is claimed is:

1. Apparatus to place a bag on a spout to receive a tightly compressed material comprising:

a magazine to hold a stack of bags said bags having open ends and closed ends and with their closed ends facing toward the center of the apparatus;

a spout positioned below the magazine, the said spout having expandable jaws to grip a bag with one end of the spout adapted to receive the open end of a bag and the opposite end of the spout adapted to receive the compressed material;

an elevator to hold a bag lengthwise moveable between an up position adjacent the magazine and a down position aligned with the spout;

a gripper arm moveable from a position over the closed ends of the bags on the magazine lengthwise of the elevator, the said gripper arm having grippers extendable into the magazine to grip and lift the closed end of the top bag in the stack;

means to move the gripper bar and the bag held by the grippers along the elevator and place the bag on the elevator;

means to lower and raise the elevator;

upper and lower opening bars provided with vacuum cups facing each other positioned adjacent the bag end of the spout;

means to move the elevator and bag horizontally to bring the open end of the bag between the opening bars to permit the opening vacuum cups to grip opposite faces of the open end of the bag;

means to separate the opening bars and open the bag;

a finger assembly comprising a pair of bars moveable horizontally on stationary rods along the opposite faces of the spout and fingers adapted to rotate into the mouth of the bag when the bag is almost opened and grip the bag;

means to move the bars of the finger assembly and the bag gripped by the finger onto the spout for substantially the full length of the bag; and means to expand the jaws of the spout;

whereby the bag will be held on the spout ready to receive the compressed material through the spout and then be pushed from the spout.

2. The apparatus of claim 1 in which the magazine is tilted downward at the closed ends of the bags in the magazine to keep bags in position in the magazine.

3. The apparatus of claim 1 in which ribs are positioned across the magazines to help keep the stack of bags from shifting during operation.

* * * * *